US009890590B2

(12) United States Patent
Budziak et al.

(10) Patent No.: US 9,890,590 B2
(45) Date of Patent: Feb. 13, 2018

(54) BUILDING ROOF SAFETY ASSEMBLY HAVING A BARRIER AND LADDER RESTRAINT

(71) Applicant: NSAFE Engineering Inc., Toronto (CA)

(72) Inventors: Chester J. Budziak, Toronto (CA); Gregory C. Budziak, Toronto (CA); Adam P. Budziak, Toronto (CA)

(73) Assignee: NSAFE Engineering Inc., Toronto, Ontario (CA)

( * ) Notice: Subject to any disclaimer, the term of this patent is extended or adjusted under 35 U.S.C. 154(b) by 0 days.

(21) Appl. No.: 13/949,577

(22) Filed: Jul. 24, 2013

(65) Prior Publication Data

US 2015/0027812 A1 Jan. 29, 2015

(51) Int. Cl.
*E06C 7/48* (2006.01)
*E04G 21/32* (2006.01)

(52) U.S. Cl.
CPC ..... *E06C 7/48* (2013.01); *E04G 21/3238* (2013.01); *E06C 7/484* (2013.01)

(58) Field of Classification Search
CPC ..... E04G 5/14; E04G 21/3238
USPC ..... 182/107
See application file for complete search history.

(56) References Cited

U.S. PATENT DOCUMENTS 4,253,547 A * 3/1981 Skaalen et al. ..... 182/115
4,909,483 A 3/1990 Van Herpen
5,188,342 A 2/1993 Ouellette et al.
5,599,006 A * 2/1997 Gevaux et al. ..... 256/25
5,775,465 A 7/1998 Vossler
6,533,069 B1 * 3/2003 Couillard ..... 182/83
6,578,827 B2 * 6/2003 McCracken ..... E04D 11/00 256/24
6,619,610 B1 * 9/2003 Genovese ..... 248/519
6,722,469 B1 4/2004 Weger, Jr.
6,942,199 B2 9/2005 Higgs et al.
6,957,794 B2 * 10/2005 Landreville et al. ..... 248/124.2
7,093,322 B2 8/2006 Townend
8,783,415 B2 * 7/2014 Bancroft ..... 182/107
2006/0237263 A1 * 10/2006 Gaines ..... 182/113
2007/0278040 A1 12/2007 Rager

FOREIGN PATENT DOCUMENTS

FR 2236373 A * 3/1975

* cited by examiner

*Primary Examiner* — Alvin Chin-Shue

(57) ABSTRACT

A safety assembly is provided for placement on a roof of a building, near an edge of the roof, having a ladder restraint, an upstanding barrier, and a counterweight. The ladder restraint has an opening to receive a ladder that provides access to the roof. The opening is sized to restrict left and right sideways movement of the ladder. The upstanding barrier extends on left and right sides of the ladder restraint to block falls by a user. The counterweight is interconnected to both the ladder restraint and the upstanding barrier, and is disposed to prevent forward tipping of the upstanding barrier by the user, and to prevent sideways tipping of the ladder during use, when the safety assembly is placed on the roof and the ladder is received through the ladder restraint. The safety assembly may be assembled on the roof without penetrating the roof's waterproofing membrane.

17 Claims, 16 Drawing Sheets

BUILDING ROOF SAFETY ASSEMBLY HAVING A BARRIER AND LADDER RESTRAINT

FIELD

This disclosure relates to roof safety assemblies, and more particularly, to a safety assembly for placement on a building roof to prevent workers from falling from that roof and to prevent tipping of ladders used by those workers to access that roof.

BACKGROUND

Workers working on building roofs risk serious injury or even death in the event of a fall from that roof or in the event of tipping of a ladder used to access that roof. As such, many jurisdictions impose workplace safety rules to govern conditions for accessing and working on roofs. For example, in Ontario, Canada, regulations enacted under the Occupational Health and Safety Act require guard rails to be installed on a building roof, if the building roof does not have a parapet of sufficient height to prevent workers from falling off. Those regulations also require the use of devices to secure the top ends of ladders used for roof access, to prevent falls caused by accidental tipping of those ladders. Similar requirements exist in other jurisdictions.

Various ways of erecting guard rails on roofs are known. For example, guard rails may be erected using support posts bolted or otherwise securely planted into roofs. It is also known to erect guard rails using support posts that are each attached to a heavy weight. However, while guard rails protect workers from falls while they are on a roof, they do nothing to protect workers from falls while they are ascending or descending on ladders used to access that roof. Thus, any ladder used to access that roof must be separately secured, as required by safety regulations.

Accordingly, there is a need for improved roof safety apparatuses.

SUMMARY

According to an aspect of the present disclosure, there is provided a safety assembly for placement on a roof of a building, near an edge of the roof. The safety assembly includes a ladder restraint having an opening to receive a ladder that provides access to the roof. The opening is sized to restrict left and right sideways movement of the ladder when received therethrough. The safety assembly also includes an upstanding barrier that extends on left and right sides of the ladder restraint to block falls by a user. The safety assembly also includes a counterweight interconnected with the ladder restraint and the upstanding barrier and disposed to prevent forward tipping of the upstanding barrier by the user, and to prevent sideways tipping of the ladder during use by the user, when the safety assembly is placed on the roof and the ladder is received through the ladder restraint.

According to another aspect of the present disclosure, there is provided a method of providing access to a roof of a building. The method includes providing a ladder restraint attached to a counterweight, the ladder restraint having an opening to receive a ladder for accessing the roof, the opening sized to restrict left and right sideways movement of the ladder when received therethrough; receiving the ladder through the ladder restraint; and counteracting lateral forces on the ladder during use by a user, by way of the counterweight, to prevent the forces from tipping the ladder.

According to yet another aspect of the present disclosure, there is provided a kit for assembling a roof safety assembly, to be placed on a roof of a building near its edge. The kit includes a ladder restraint having an opening for receiving a ladder, the opening sized to restrict left and right sideways movement of the ladder when the ladder is received through the opening; a barrier to block falls by a user; and a counterweight, for interconnection with the barrier and the ladder restraint, that prevents forward tipping of the barrier by the user when the counterweight is interconnected with the barrier, and prevents sideways tipping of the ladder during use by the user, when the counterweight is interconnected with the ladder restraint and the ladder is received through the ladder restraint.

Other features will become apparent from the drawings in conjunction with the following description.

BRIEF DESCRIPTION OF THE DRAWINGS

In the figures which illustrate example embodiments.

DETAILED DESCRIPTION

Figure 1:
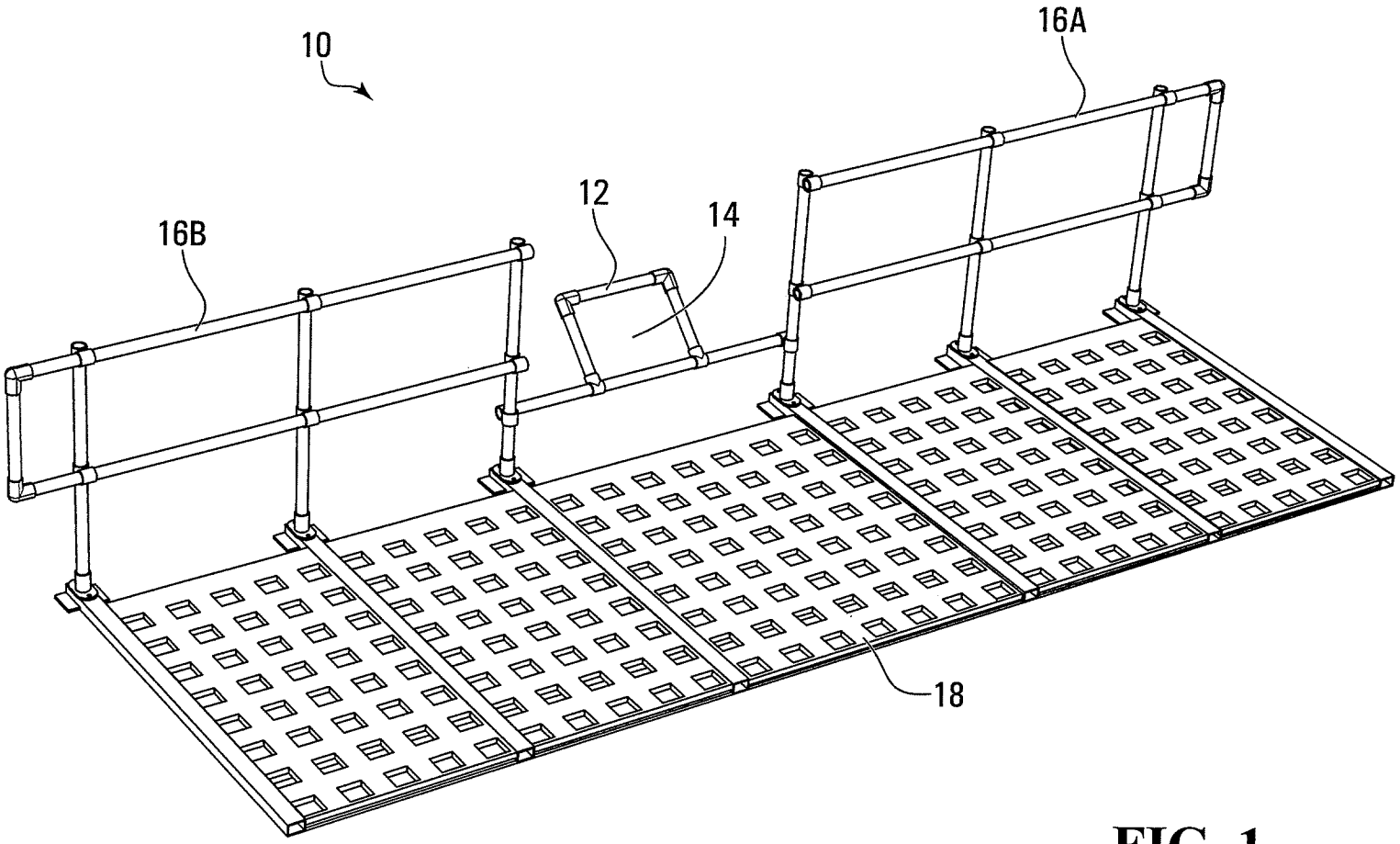
FIG. 1 is a rear perspective view of a roof safety assembly, exemplary of an embodiment.

FIG. 1 depicts a roof safety assembly 10, exemplary of an embodiment. As will become apparent, roof safety assembly 10, when placed on a substantially flat or gently sloping building roof near an edge of that roof, protects workers from falls from that roof, and also protects workers from falls caused by accidental tipping of a ladder used to access that roof. As such, roof safety assembly 10 may be placed on building roofs that otherwise lack fall protection features or require existing safety features to be supplemented, to protect workers who work on and access those roofs.

Roof safety assembly 10 includes a ladder restraint 12 having an opening 14 for receiving a ladder. A ladder received through opening 14 is secured from accidental tipping, as detailed below. Roof safety assembly 10 also includes upstanding barriers 16A and 16B for blocking falls by a worker. Barriers 16A and 16B are erected to extend on either side of ladder restraint 12, along at least one edge of roof safety assembly 10. Roof safety assembly 10 also includes base 18 that supports roof safety assembly 10 on a roof, and provides a flat working surface. As will be detailed below, base 18 includes a counterweight that both prevents a worker from tipping barriers 16A and 16B towards a roof edge, and prevents sideways tipping of a ladder secured by ladder restraint 12 while a worker uses that ladder.

As noted, roof safety assembly 10 includes upstanding barriers 16A and 16B to block falls, e.g., by a worker on base 18. As such, upstanding barriers 16A and 16B are fixedly mounted to base 18, and are sized to extend along one side of base 18 at a height sufficient to block passage of a worker. The height of each of barriers 16A and 16B in the depicted embodiment is approximately 3½ feet. However, as will be appreciated, this height may be changed in other embodiments to suit particular roof setting and/or suit particular safety requirements, which may vary from jurisdiction to jurisdiction.

In the depicted embodiment, barriers 16A and 16B each take the form of guard rails. However, in other embodiments, one or both of barriers 16A and 16B may be replaced with fences, walls, or any combination of fences, walls, rails, or the like, suitable to block passage of a worker.

Figure 2:
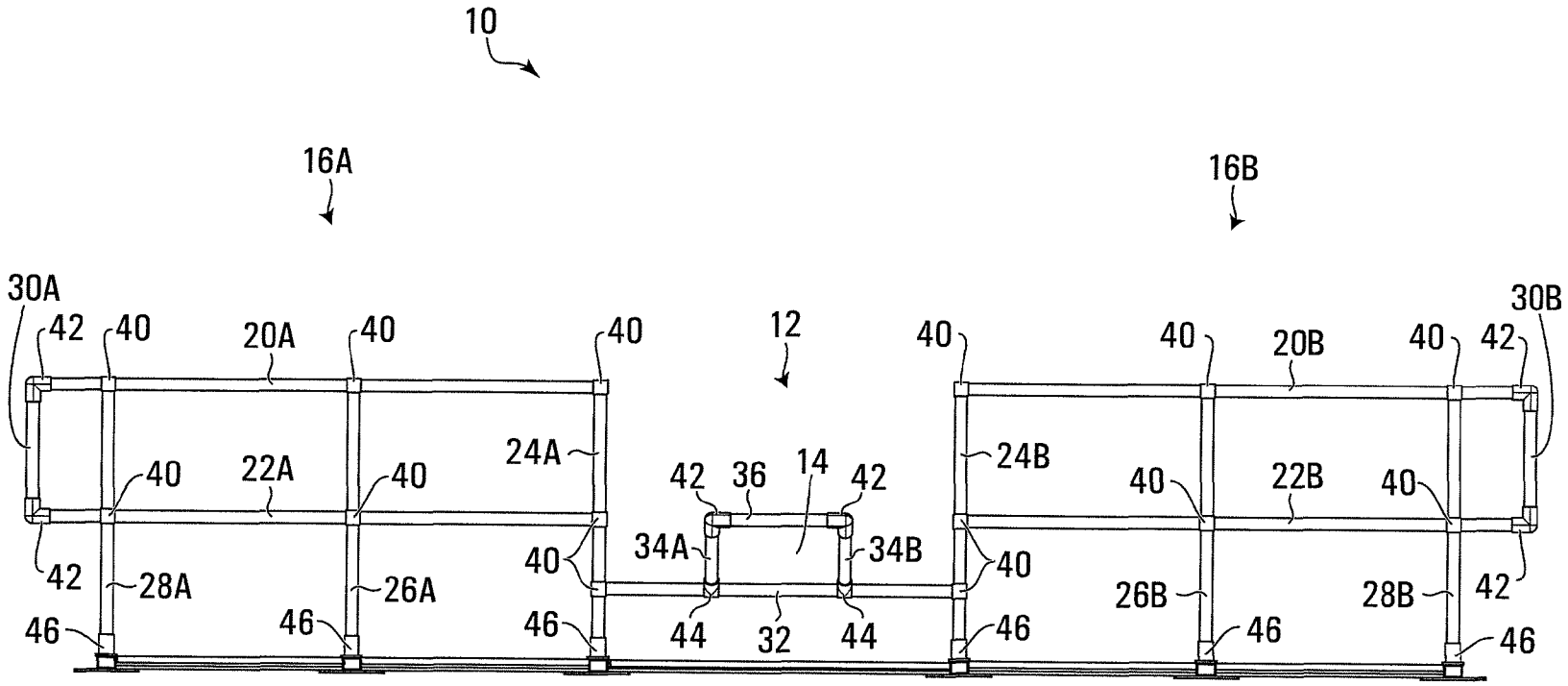
FIG. 2 is a front elevation view of the roof safety assembly of FIG. 1.
Figure 3:
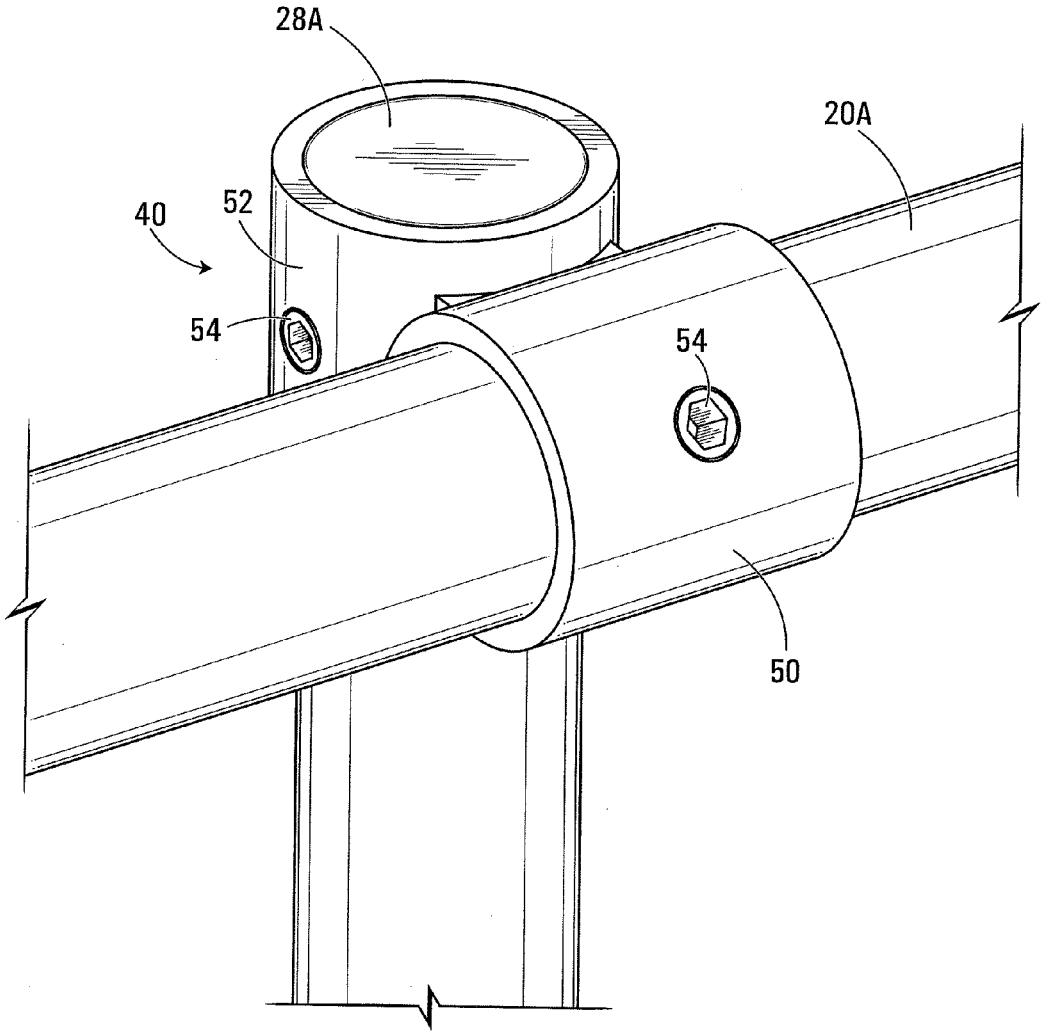
FIG. 3 is a rear perspective view of a fitting used to interconnect guard rail members of the roof safety assembly of FIG. 1.
Figure 4:
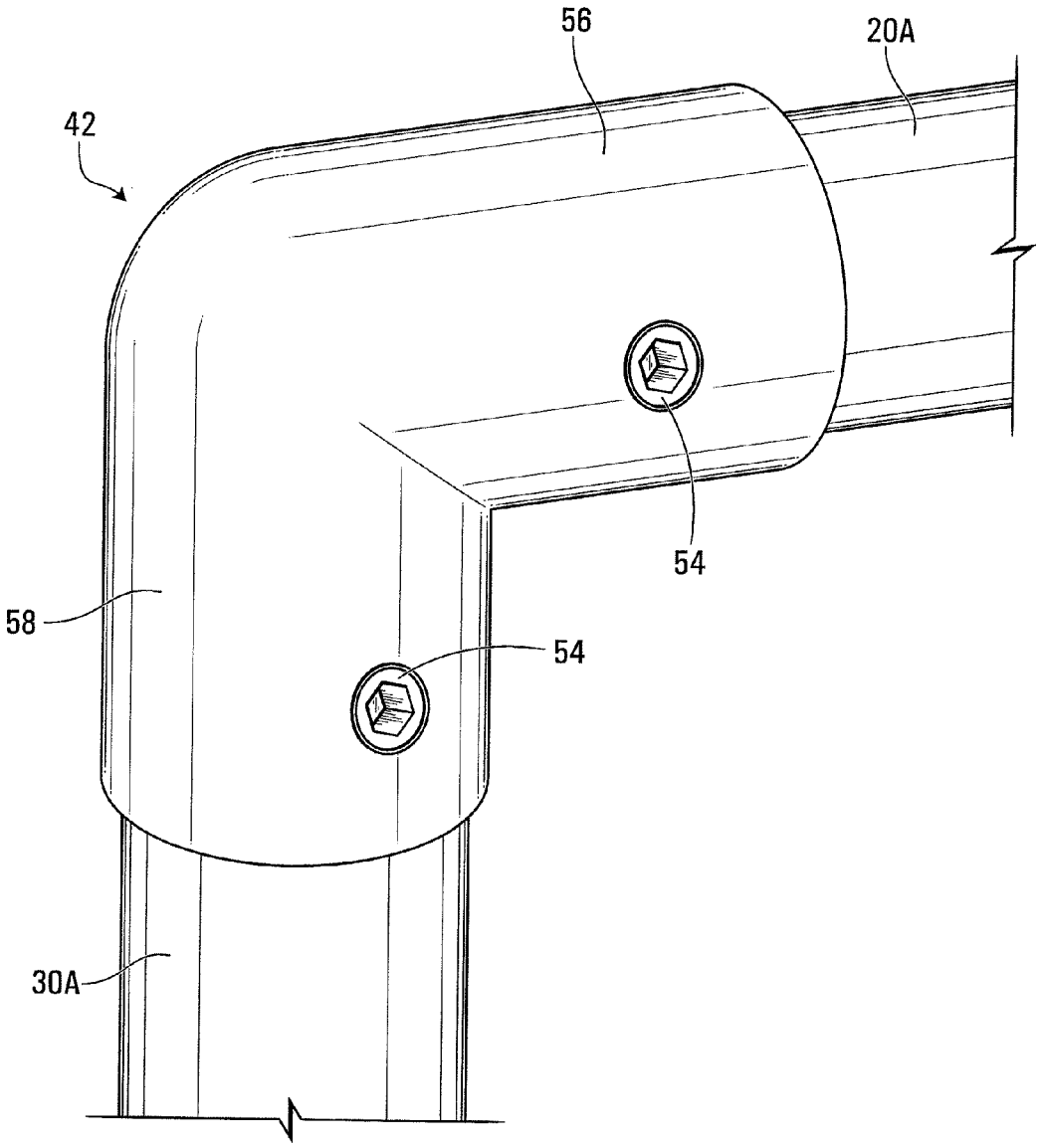
FIG. 4 is a rear perspective view of another fitting used to interconnect guard rail members of the roof safety assembly of FIG. 1.

As depicted in FIG. 2, barrier 16A includes a top horizontal rail member 20A and a mid horizontal rail member 22A that extend along the length of barrier 16A. Horizontal rail members 20A and 22A are attached to posts 24A, 26A and 28A using a plurality of 90-degree cross-over fittings 40 (e.g., as shown in FIG. 3). Barrier 16A extends from an end proximate ladder restraint 12 to an opposite end terminated by a left-handed D-return formed by attaching vertical rail member 30A to horizontal rail members 20A and 22A using two 90-degree elbow fittings 42 (e.g., as shown in FIG. 4). Each of posts 24A, 26A, and 28A are respectively attached to base 18 using three socketed flanges 46.

Barrier 16B extends on the side of ladder restraint 12 opposite barrier 16A. In the depicted embodiment, barrier 16B is symmetrical to barrier 16A about a vertical plane that bisects ladder restraint 12. Similar to barrier 16A, barrier 16B includes a top horizontal rail member 20B and a mid horizontal rail member 22B that extend along the length of barrier 16B. Horizontal rail members 20B and 22B are attached to posts 24B, 26B and 28B using a plurality of 90-degree cross-over fittings 40.

The end of barrier 16B opposite ladder restraint 12 is terminated by a right-handed D-return formed by attaching vertical rail member 30B to horizontal rail members 20B and 22B using two 90-degree elbow fittings 42.

In the depicted embodiment, each of the rail members and posts of barriers 16A and 16B are substantially cylindrical in shape. In other embodiments, these rail members and/or posts could have other shapes providing structural strength sufficient to meet safety requirements.

As best seen in FIG. 3, a 90-degree cross-over fitting 40 includes two hollow cylindrical portions 50 and 52, oriented at right angles to each other. Cylindrical portion 50 has an inner diameter complementary to the diameter of horizontal rail member 20A/B and 22A/B, while cylindrical portion 52 has an inner diameter complementary to the diameter of posts 24A/B, 26A/B and 28A/B. By way of example, FIG. 3 illustrates the use of a 90-degree cross-over fitting 40 to attach horizontal rail member 20A to post 28A. As depicted, horizontal rail member 20A is inserted through cylindrical portion 50 and fastened therein using a grub screw 54. Meanwhile, post 28A is inserted through cylindrical portion 52 and fastened therein using another grub screw 54.

Each grub screw 54 may be a conventional grub screw, and may be formed from case-hardened steel or a like material. Each grub screw 54 includes a socket such as, for example, a hexagon socket to permit tightening/loosening by a conventional hexagonal key.

The use of 90-degree cross-over fitting 40 elsewhere in roof safety assembly 10 follows the example shown in FIG. 3, and is not further detailed herein.

As best seen in FIG. 4, a 90-degree elbow fitting 40 includes two socketed portions 56 and 58, oriented at right angles to each other. Socketed portion 58 has an inner socket diameter complementary to the diameter of vertical rail members 30A/B, while socketed portion 56 has an inner socket diameter complementary to the diameter of horizontal rail member 20A/B and 22A/B. By way of example, FIG. 4 illustrates the use of a 90-degree elbow fitting 40 to attach horizontal rail member 20A to vertical rail member 30A. As depicted, horizontal rail member 20A is inserted into socketed portion 56 and fastened therein using a grub screw 54, while vertical rail member 30A is inserted into socketed portion 58 and fastened therein using another grub screw 54.

The use of 90-degree elbow fitting 40 elsewhere in roof safety assembly 10 follows the example shown in FIG. 4 and is not further detailed herein.

Upstanding barriers 16A and 16B are spaced to provide a gap therebetween to allow ingress/egress by a worker using a ladder positioned proximate to that gap, and to mount ladder restraint 12 for securing that ladder. As such, barriers 16A and 16B are spaced to provide a gap of sufficient width to allow a worker to step off the ladder received in ladder restraint 12 on to base 18, and to allow a worker to climb on to on to the ladder from base 18. In the depicted embodiment, the gap between barriers 16A and 16B is approximately 5 feet in width, but this width may be adjusted in other embodiments to suit particular roof settings and particular safety requirements.

Further, in the depicted embodiment, ladder restraint 12 is mounted centrally between barriers 16A and 16B such that a worker may ingress/egress from either the left side or the right side of a ladder received in ladder restraint 12. Conveniently, workers may elect to ingress/egress from one side or the other based on their handedness. In other embodiments, ladder restraint 12 may be mounted to be next to barrier 16A or 16B, and thus allow workers to ingress/egress on only one side (i.e., the left side or the right side) of a ladder received in ladder restraint 12.

As depicted, the gap between 16A and 16B is bridged by a horizontal bar 32 for mounting ladder restraint 12. In the depicted embodiment, horizontal bar 32 is substantially cylindrical in shape. Horizontal bar 32 is attached to post 24A of barrier 16A and to post 24B of barrier 16B using two 90-degree cross-over fittings 40, in a manner similar to that shown in FIG. 3.

In some embodiments, horizontal bar 32 may be mounted at a height that allows a ladder to be rested against bar 32 without contacting the edge of a roof, the edge of roof parapet, and/or roof fixtures such as, e.g., an eavestrough. Conveniently, this prevents those edge and/or fixtures from being damaged by a ladder rested thereagainst, or otherwise makes contact therewith. Similarly, resting a ladder against roof features that would not provide stable support for a ladder, such as, e.g., curved edges or canted edges of roofs or parapets may be avoided. In other embodiments, horizontal bar 32 may be mounted at a height that allows a ladder received in ladder restraint 12 to be rested on the edge of a roof or roof parapet.

Ladder restraint 12 of roof safety assembly 10 is used to secure a ladder used to access a building roof. Ladder restraint 12 is shaped to define an opening 14 for receiving a ladder, with opening 14 sized to secure a ladder received therethrough. In particular, opening 14 is sized to restrict left and right sideways movement of a ladder received therethrough. Ladder restraint 12 may, for example, comprise two parallel posts spaced to provide opening 14. In some embodiments, ladder restraint 12 may be shaped to encircle a ladder at least partially, to prevent the ladder from tipping backwards out of opening 14. Ladder restraint 12 may also be shaped to encircle a ladder completely, e.g., ladder restraint 12 may be U-shaped or hoop-shaped, or the like. In the depicted embodiment, ladder restraint 12 is shown to be formed from separate components, but ladder restraint 12 could also be formed as a unitary body in other embodiments.

Figure 6A:
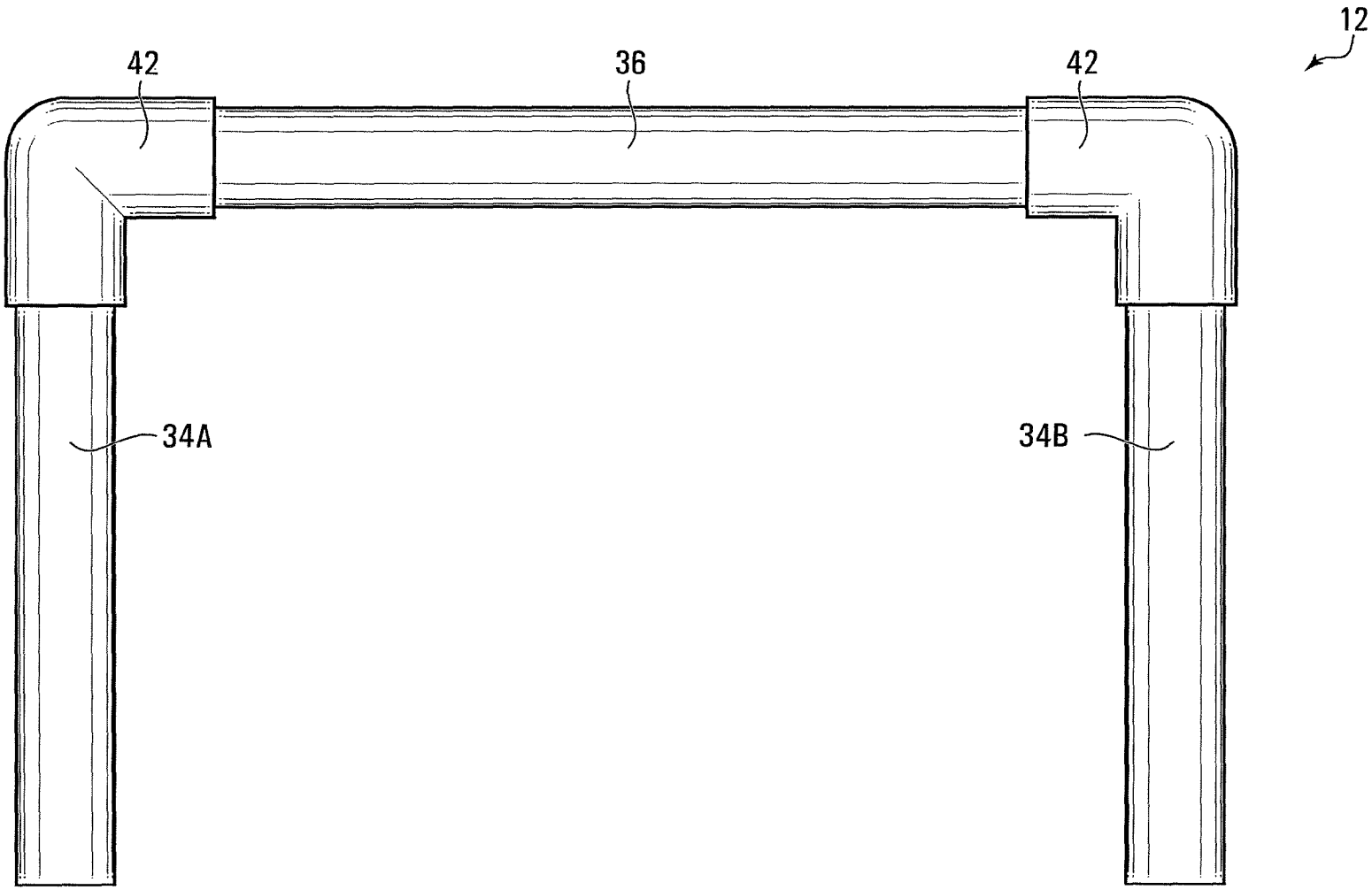
FIGS. 6A, 6B, 6C and 6D are each front elevation views of a ladder restraint of the roof safety assembly of FIG. 1, exemplary of four embodiments, respectively.

As depicted in FIG. 6A, ladder restraint 12 is formed using posts 34A and 34B and bar 36, each of which is substantially cylindrical in shape. Specifically, ladder restraint 12 is formed by attaching bar 36 to posts 34A and 34B using two 90-degree elbow fittings 42, in a manner similar to that shown in FIG. 4.

Figure 5:
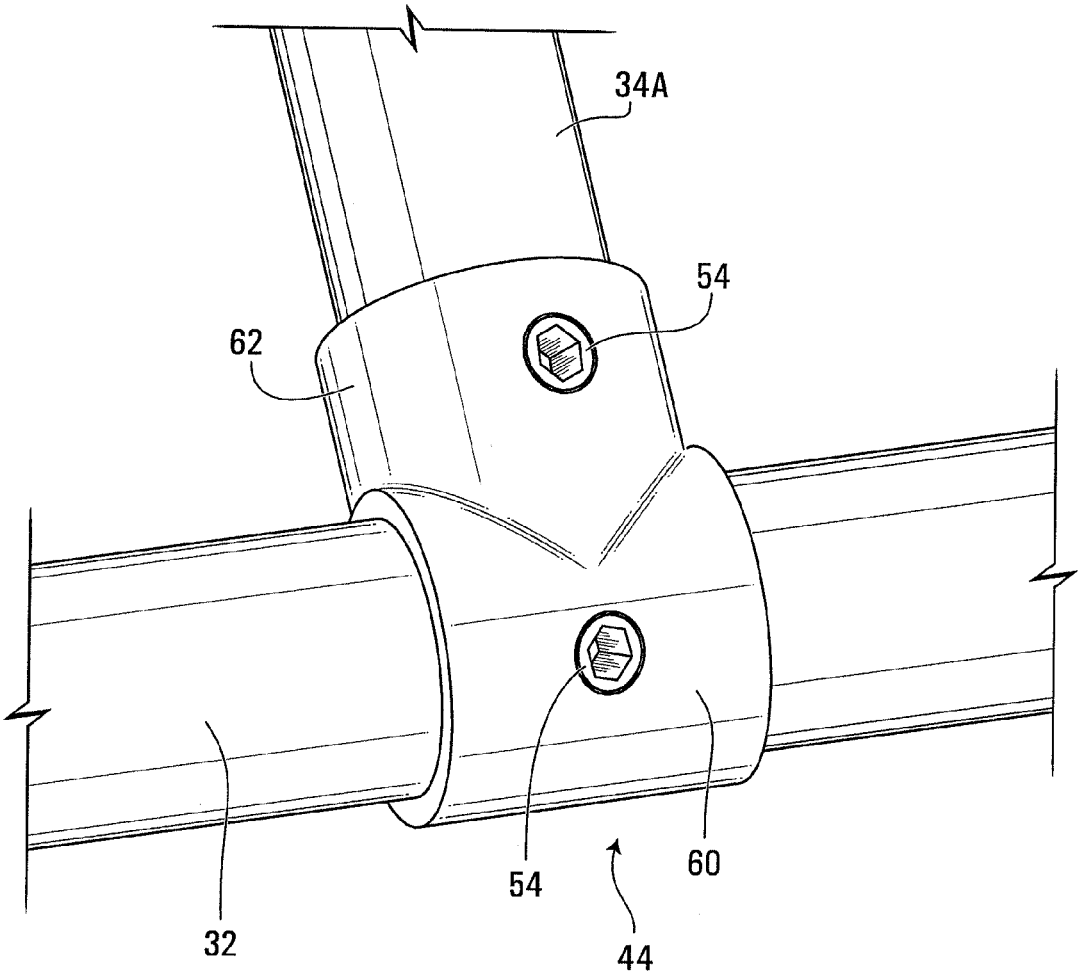
FIG. 5 is a rear perspective view of a fitting used to mount a ladder restraint of the roof safety assembly of FIG. 1.

Ladder restraint 12 is mounted to horizontal bar 32 by attaching posts 34A and 34B to horizontal bar 32 using respective tee fittings 44. As best seen in FIG. 5, a tee fitting 40 includes a hollow cylindrical portion 60 oriented at a right angle to socketed portion 62. Cylindrical portion 60 has an inner diameter complementary to the diameter of horizontal bar 32, while socketed portion 62 has an inner socket diameter complementary to the diameter of posts 34A/B. As depicted, horizontal bar 32 is inserted through cylindrical portion 60 and fastened therein using a grub screw 54, while post 34A is inserted into socketed portion 62 and fastened therein using another grub screw 54. The opposite end of horizontal bar 32 is secured to post 34B using another tee fitting 40, in a similar manner.

Once ladder restraint 12 is mounted, posts 34A/B, bar 36 and bar 32 define opening 14 for receiving a ladder therethrough. As such, post 34A and 34B are spaced far enough apart to make opening 14 wide enough to receive a ladder. At the same time, posts 34A and 34B are spaced close enough together to restrict left and right sideways movement of that ladder when it is received through opening 14. In the depicted embodiment, posts 34A and 34B are spaced to make opening 14 approximately 21 inches wide. However, in other embodiments, posts 34A and 34B may be spaced closer together or farther apart to accommodate ladders of different widths, and may vary according to regulations governing the width of ladders used in particular jurisdictions.

As will be appreciated, when a ladder is received through opening 14 of ladder restraint 12, bar 36 that extends along the top of opening 14 serves to prevent the ladder from tipping backwards out of opening 14.

Figure 6B:
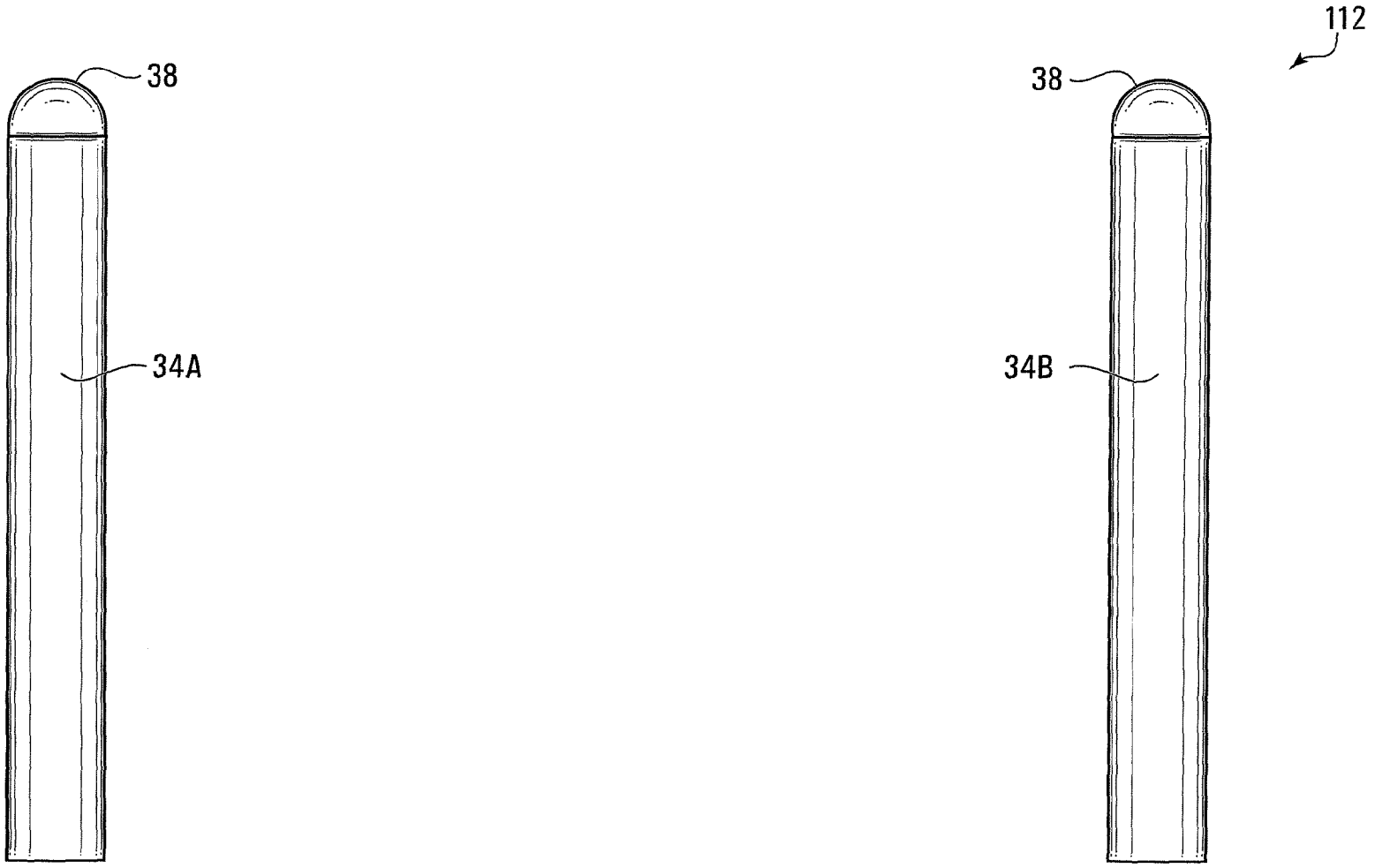

FIG. 6B depicts ladder restraint 112, according to an embodiment in which bar 36 of ladder restraint 12 is omitted. Such an embodiment may be suitable for use in settings where backwards tipping of a ladder is not a concern. Omitting bar 36 allows a ladder to be lowered into the opening of the ladder restraint from above the ladder restraint. This facilitates ready placement of a ladder into the opening of the ladder restraint, even in settings where view of the opening from the ground is partly or fully occluded, e.g., by obstructions below a roof parapet. In such embodiments, the two 90-degree elbow fittings 42 used to attach posts 34A and 34B to bar 36 may be replaced with plugs 38 to terminate the top ends of posts 34A and 34B.

Figure 6C:
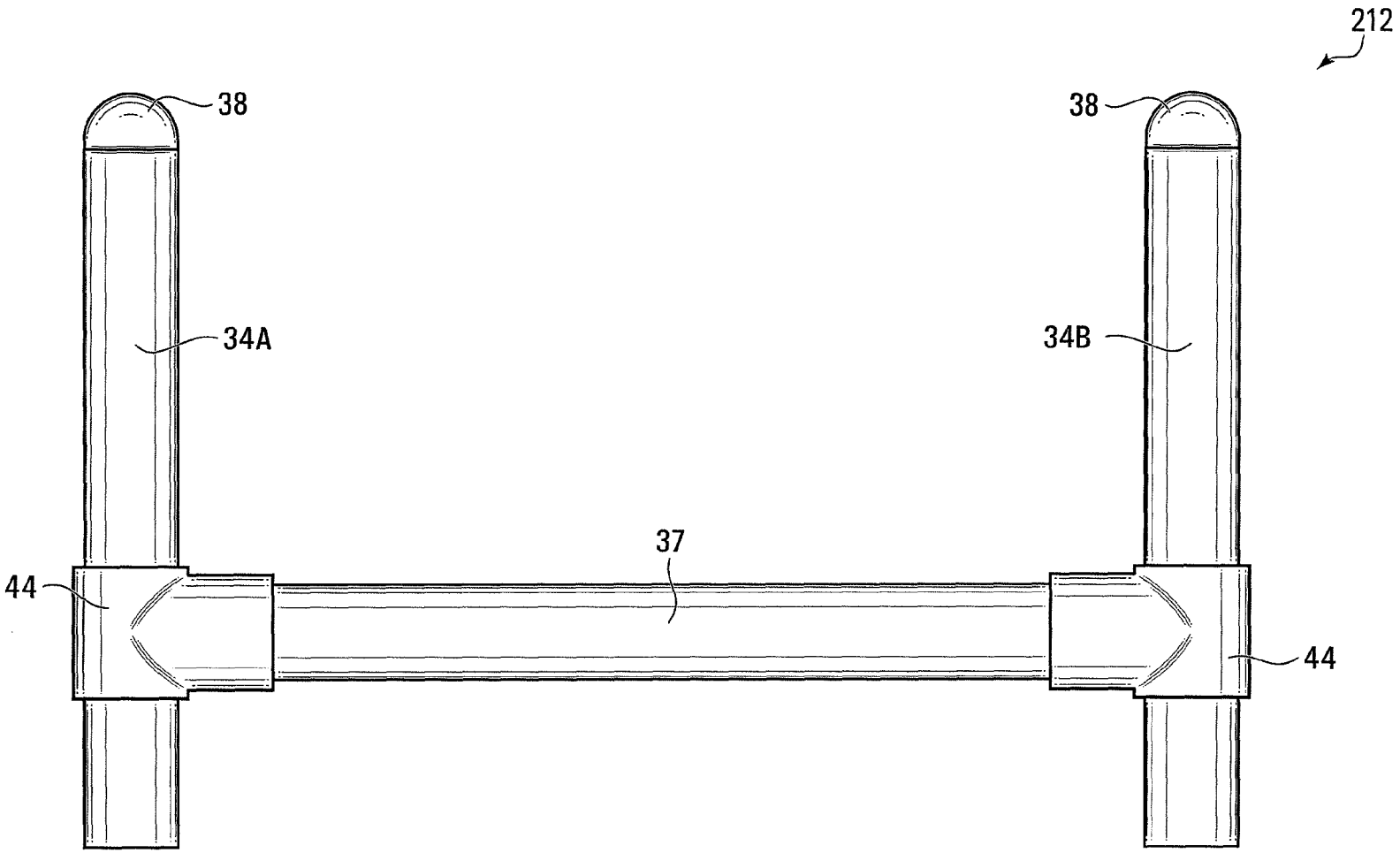

FIG. 6C depicts ladder restraint 212, according to a yet another embodiment. Like ladder restraint 112 (FIG. 6B), ladder restraint 212 does not include bar 36 of ladder restraint 12. However, as depicted, ladder restraint 212 includes a bar 37 that extends between posts 34A and 34B. Bar 37 is mounted to posts 34A and 34B using respective tee fittings 44 at a height that allows a ladder to be rested against bar 37 without contacting the edge of a roof, the edge of roof parapet, roof fixtures that might be damaged such as, e.g., eavestroughs, and/or roof features that would not provide stable support for a ladder such as, e.g., curved edges or canted edges. As will be appreciated, bar 37 is mounted at a height sufficiently below the top ends of posts 34A and 34B to allow a ladder to be securely retained between posts 34A and 34B.

Figure 6D:
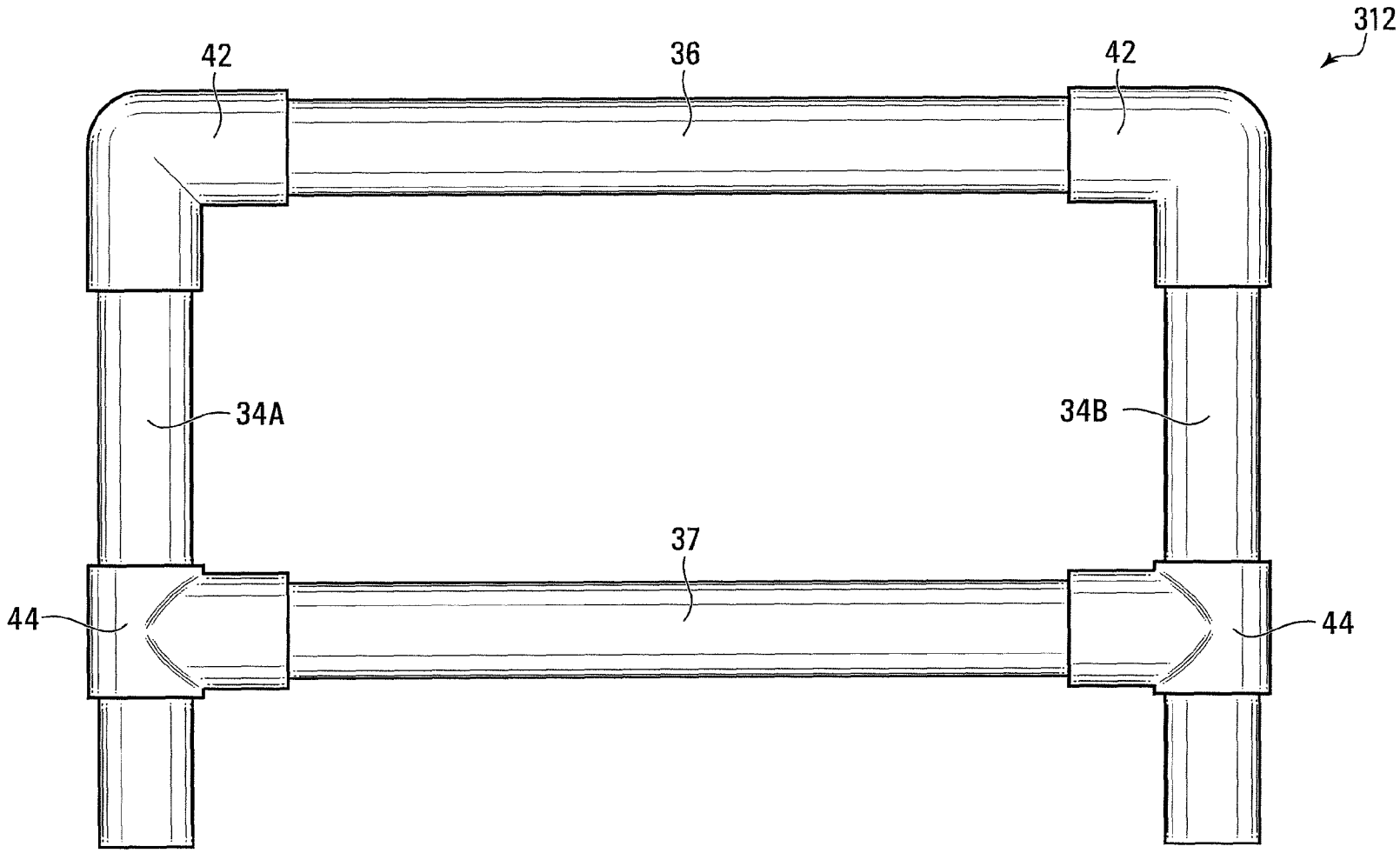

FIG. 6D depicts ladder restraint 312, according to yet another embodiment. As depicted, ladder restraint 312 includes both bar 37, which provides a support against which a ladder may be rested, and bar 36, which prevents the ladder from tipping backwards out of ladder restraint 312.

Figure 7:
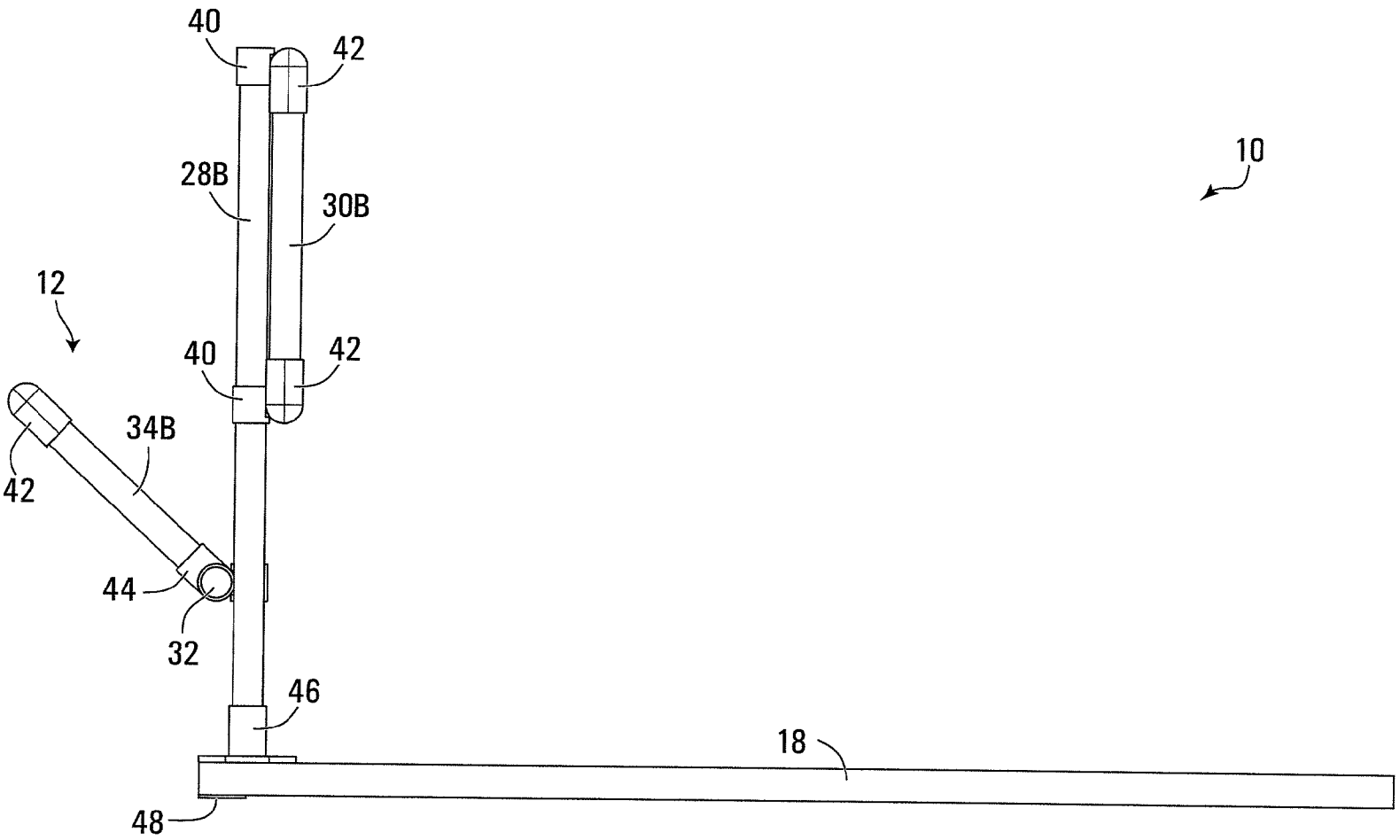
FIG. 7 is a right elevation view of the roof safety assembly of FIG. 1.

As best seen in FIG. 7, ladder restraint 12 is mounted on horizontal bar 32 to extend away from barriers 16A/B, such that, when roof safety assembly 10 is placed on a roof near an edge of that roof, ladder restraint 12 extends in a direction towards that edge. Further, ladder restraint 12 is mounted on horizontal bar 32 at an angle offset from upstanding barriers 16A/B. In the depicted embodiment, this angle is approximately 45°. In other embodiments, ladder restraint 12 may be mounted on horizontal bar 32 with this angle at 0°, i.e., such that ladder restraint 12 is parallel to upstanding barriers 16A/B. In yet other embodiments, this angle may be between 0° and 90°, and may be selected to accommodate roofs of different heights, as well as roof parapets of different heights and widths. Mounting ladder restraint 12 at such an angle facilitates ready insertion of a ladder through opening 14 of ladder restraint 12 during operation.

In some embodiments, ladder restraint 12 may be mounted directly to base 18, such that horizontal bar 32 may be omitted.

The bottom end of each of posts 24A/B, 26A/B, and 28A/B is inserted into a corresponding socketed flange 46 to attach the posts to base 18. The posts are secured to socketed flanges 46, e.g., using grub screws. Socketed flanges 46 are in turn secured to elongate support members 64A/B, 66A/B, and 68A/B of base 18 (FIG. 8), e.g., also using grub screws. As depicted, in this way, each of posts 24A/B, 26A/B, and 28A/B is attached to a corresponding one of elongate support members 64A/B, 66A/B and 68A/B. The bottom end of each socked flanges 46 includes a spread plate 48 for distributing the weight of roof safety assembly 10, including the weight of barriers 16A and 16B, over an area of a roof under the spread plate 48, when roof safety assembly 10 is placed on that roof. Conveniently, use of spread plates 48 helps to prevent the roof from being damaged by point loads. In the depicted embodiment, spread plate 48 is a rectangular plate approximately 6"×12" in size. However, in other embodiments, the size and shape of spread plate 48 may be changed.

Together, barriers 16A and 16B and the gap therebetween span the length of base 18, with the D-returns at the far ends of barriers 16A and 16B extending slightly past the right and left edges of base 18. In the depicted embodiment, the total span of barrier 16A and 16B and the gap therebetween is approximately 20 feet. However, the span of barriers 16A/16B may be increased by extending horizontal bars 20A/B and 22A/B. Further, additional posts alike to posts 24A/B-28A/B may be added to support the extended horizontal bars. Conversely, the span of barriers 16A/B may be decreased by shortening horizontal bars 20A/B and 22A/B, and removing one or more of posts 24A/B-28A/B as necessary. The heights of each of barriers 16A and 16B may be changed in other embodiments by increasing or decreasing the lengths of post 24A/B-28A/B.

Each of the rails members and post forming barriers 16A/B, each of the bars and posts forming ladder restraint 12, as well as horizontal mounting bar 36, may be hollow tubing or solid bars formed from metal such as iron, steel, aluminum, or the like. These components may be formed by casting. For resistance to rusting, components formed from stainless steel, aluminum or galvanized metal may be used. In some embodiments, these components may be made from high-stiffness plastics such as, for example, fiberglass-reinforced plastic. Such plastic components may be formed from conventional, molding or extrusion/pultrusion processes. Some or all of these components may be sized to have a diameter/width suitable for gripping, e.g., approximately 1-2 inches.

Fittings and flanges of roof safety assembly 10, described above, may be formed from materials similar to the rail members, bars and posts, such as, for example, cast iron or cast aluminum, or any other suitable alloy or stiff plastic.

Although grub screws are used to interconnect components of roof safety assembly 10 in the depicted embodiment, other ways to fasten these components may be used in other embodiments. For example, components (e.g., a rail member and a fitting) may be fastened together using bolts, rivets, pins, etc. In some embodiments, rail members may be fastened to fittings by way of crimping. In yet other embodiments, rail members may fastened to other rail members directly (e.g., by welding) such that some or all of the fittings may be avoided. Yet other suitable ways to interconnect components of roof safety assembly 10 will be readily apparent to those skilled in the art.

Further, although barrier 16A and 16B are terminated by respective D-returns in the depicted embodiment, in other embodiments, one or both of barriers 16A and 16B may simply be terminated by plugs inserted into the ends of horizontal rail members 20A/B and 22A/B. In yet other embodiments, one or both of barriers 16A and 16B may be terminated by flanges suitable for affixing barrier 16A/16B to a wall.

As noted, roof safety assembly 10 includes base 18 to support roof safety assembly 10 on a roof and to provide a flat working surface. Further, base 18 includes a counterweight that prevents upstanding barriers 16A/16B from being tipped towards a roof edge by a worker, and also prevents sideways tipping of a ladder received in ladder restraint 12 while a worker is using the ladder. To this end, base 18 includes a plurality of weighted elements that have sufficient mass and that are positioned to provide this counterweight, as detailed below.

Base 18 includes a plurality of elongate support members 64A/B, 66A/B, and 68A/B, which extend from barriers 16A/16B towards the back of roof safety assembly 10. Collectively, elongate support members 64A/B, 66A/B, and 68A/B serve to support roof safety assembly 10 on a roof surface.

Figure 8:
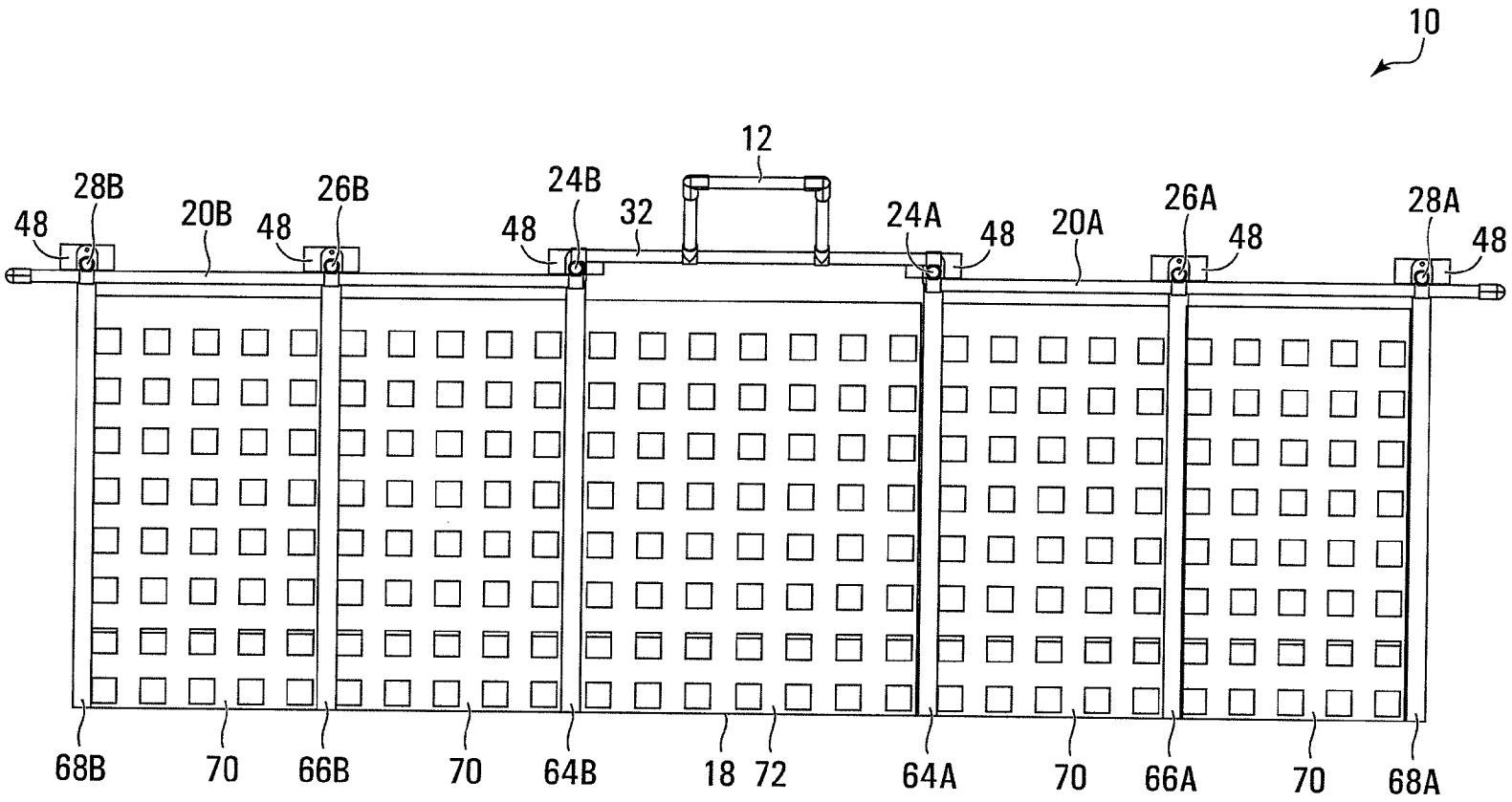
FIG. 8 is a top plan view of the roof safety assembly of FIG. 1.

As depicted in FIGS. 1 and 8, the top surface of base 18 is covered with four panels 70 and a panel 72. Panels 70 and 72 are substantially rectangular in shape and rest in between elongate support members 64A/B, 66A/B, and 68A/B on recessed support rails extending along those elongate support members, as detailed below. Panels 70 and 72 and elongate support members 64A/B, 66A/B, and 68A/B collectively form a substantially flat working surface, on which workers can walk.

Panels 70 and 72 may be formed from stiff plastic, such as, for example, fiberglass-reinforced plastic, formed from conventional molding or extrusion/pultrusion processes. As depicted, panels 70 and 72 may be perforated to form a grating. This reduces the weight of panels 70 and 72, facilitates water and snow run-off, and may improve traction. Conveniently, snow that falls through the grating may rest directly on the roof instead of accumulating on roof safety assembly 100. This may reduce localized loading of the roof by roof safety assembly 100, e.g., at spreader plates 48. In some embodiments, panels 70 and 72 may be formed from materials adapted to prevent slipping. In some embodiments, panels 70 and 72 may be formed from UV-protected materials adapted to prevent UV degradation. In the depicted embodiment, panels 70 and 72 are approximately 1 inch thick. In other embodiments, the thickness of panels 70 and 72 be increased or decreased. In some embodiments, panels 70 and 72 may, for example, be Fibergrate™ molded plastic grating distributed by Fibergrate Canada of Ontario, Canada.

Figure 9:
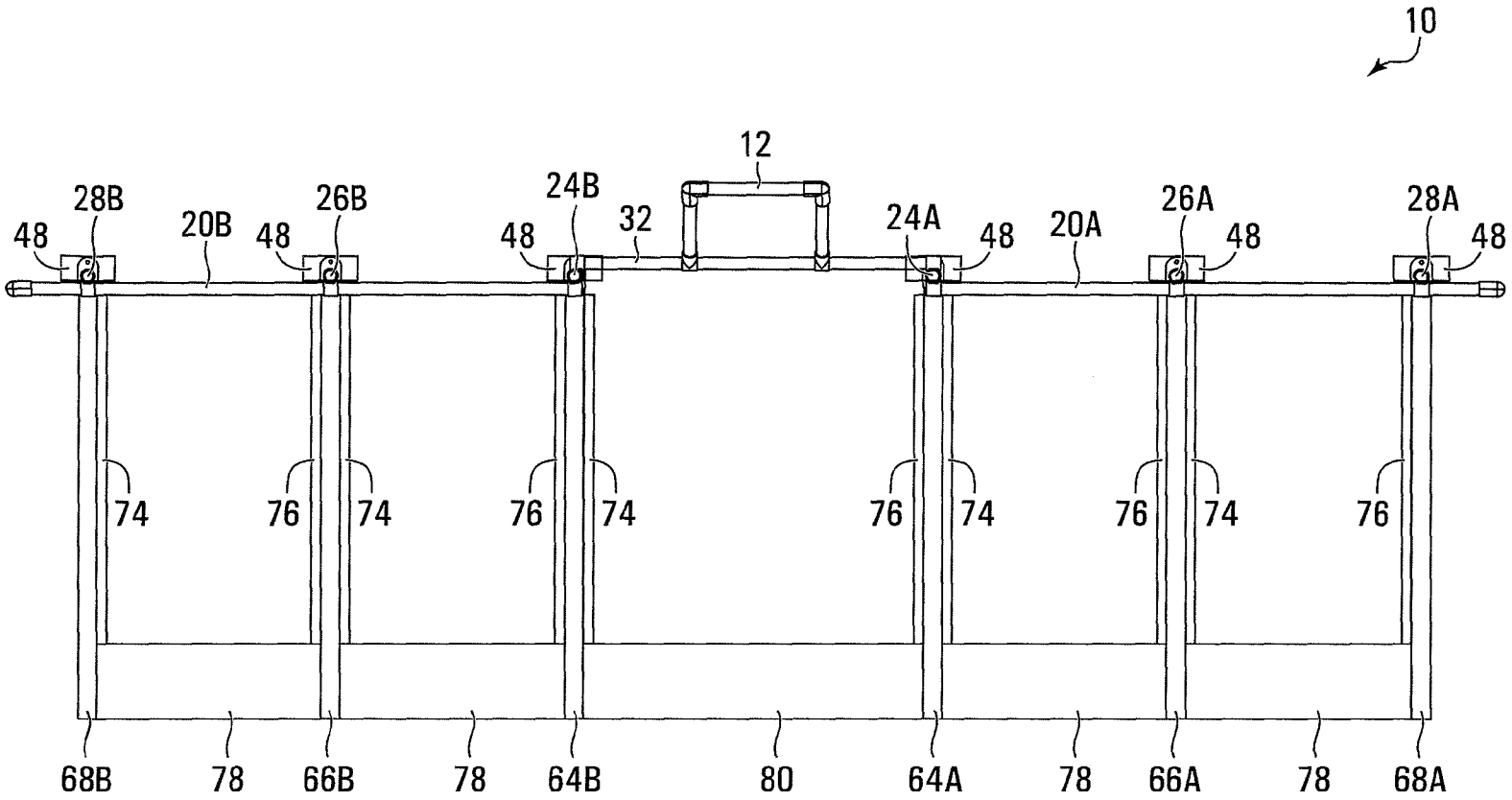
FIG. 9 is a top plan view of the roof safety assembly of FIG. 1 with its weighted elements exposed.

FIG. 9 depicts roof safety assembly 10 with panels 70 and 72 removed. Removal of 70 and 72 exposes the aforementioned support rails extending along elongate support members 64A/B, 66A/B, and 68A/B, namely, support rails 74 which extend along right side of each of the support members and support rails 76 which extend along the left side of the support members. Support rails 74 and 76 are recessed from the top surface of support members 64A/B, 66A/B, and 68A/B at a depth corresponding to the thickness of panels 70 and 72 (e.g., 1 or more inches), and extend along substantially the entire length of elongate support members 64A/B, 66A/B, and 68A/B.

FIG. 9 also depicts four weighted elements 78 and a weighted element 80 disposed at the rear of base 18. Weighted elements 78 and 80 are substantially rectangular in shape, and are sized to fit between support members 64A/B, 66A/B, and 68A/B, where they are supported by support rails 74 and 76. In some embodiments, weighted elements 78 and 80 may be securely fastened to support rails 74 and 76 and/or support members 64A/B, 66A/B, and 68A/B.

Weighted elements 78 and 80 are formed from material substantially heavier than panels 70 and 72. In the depicted embodiment, each of weighted elements 78 and 80 is formed from metal plates. Collectively, weighted elements 78 and 80 form a counterweight that serves to prevent tipping of upstanding barriers 16A/16B towards a roof edge by a worker. As will be appreciated, the tipping point of upstanding barriers 16A/16B is located at their base, along the forward edge of roof safety assembly 10. Thus, forming a counterweight at the rear of roof safety assembly 10 at a set distance from this tipping point creates a load moment that is proportional to this distance and the mass of the counterweight, which counteracts loads created by tipping of upstanding barriers 16A/16B by a worker. Conveniently, weighted elements 78 and 80 also serve to prevent tipping of a ladder away from a roof when that ladder is received in ladder restraint 12.

At the same time, the counterweight formed from weighted elements 78 and 80 also serves counteract lateral forces on a ladder to prevent sideways tipping of the ladder while a worker is using it, e.g., as caused by weight or movement of a worker on the ladder, slipping of the ladder along a building edge or parapet, unstable or uneven ladder footing, improper placement of a ladder against a building wall, wind, etc. In this situation, the tipping point is located at ladder restraint 12. Thus, forming a counterweight having portions located laterally away from ladder restraint 12 to its left and right sides creates load moments that are proportional to the left/right lateral distance between ladder restraint 12 and those portions of the counterweight. This counteracts loads created by left or right sideways tipping of a ladder secured in ladder restraint 12.

Conveniently, providing a counterweight as shown allows roof safety assembly 10 to be installed on a roof by merely placing roof safety assembly 10 on the roof. As such, there is no need to drill into or otherwise penetrate the roof, which may breach the roof's waterproofing membrane or otherwise damage the roof.

Further, forming a counterweight that extends along substantially the entire length of roof safety assembly 10, as depicted, serves to distribute the downward load of the counterweight over a larger roof area. This reduces localized loads on the roof, which may be desirable if the roof is not designed to support loads substantially beyond normal snow loads.

Although the depicted embodiment includes a counterweight formed from metal plates, other suitable weighted elements may also be used. For example, the weighted elements need not be formed from metal, but may be formed from other materials, such as concrete, stone, ceramic, sand, rubber, plastic, or the like, or combinations thereof. In some embodiments, the weighted elements may be formed from recycled materials, such as, e.g., recycled rubber, plastic, or the like. Yet other materials having density suitable for forming weighted elements will be readily apparent to those skilled in the art. Further, the number of weighted elements could vary, so long as the total mass of the weighted elements is sufficient to serve as a counterweight, as described above.

This total mass of the weighted elements may be varied to suit particular roof settings and particular safety requirements, and may also be varied based on the distance of the counterweight to the above-discussed tipping points. In the depicted embodiment, the four weighted elements 78 and weighted element 80 have a combined mass of approximately 115 kg.

Of course, the total mass of weighted elements 78 and 80 should be selected taking into account the mass of other components of roof safety assembly 10 which may also function as part of the counterweight, such as, for example, panels 70 and 72, and elongate support members 64A/B, 66A/B, and 68A/B.

Figure 10:
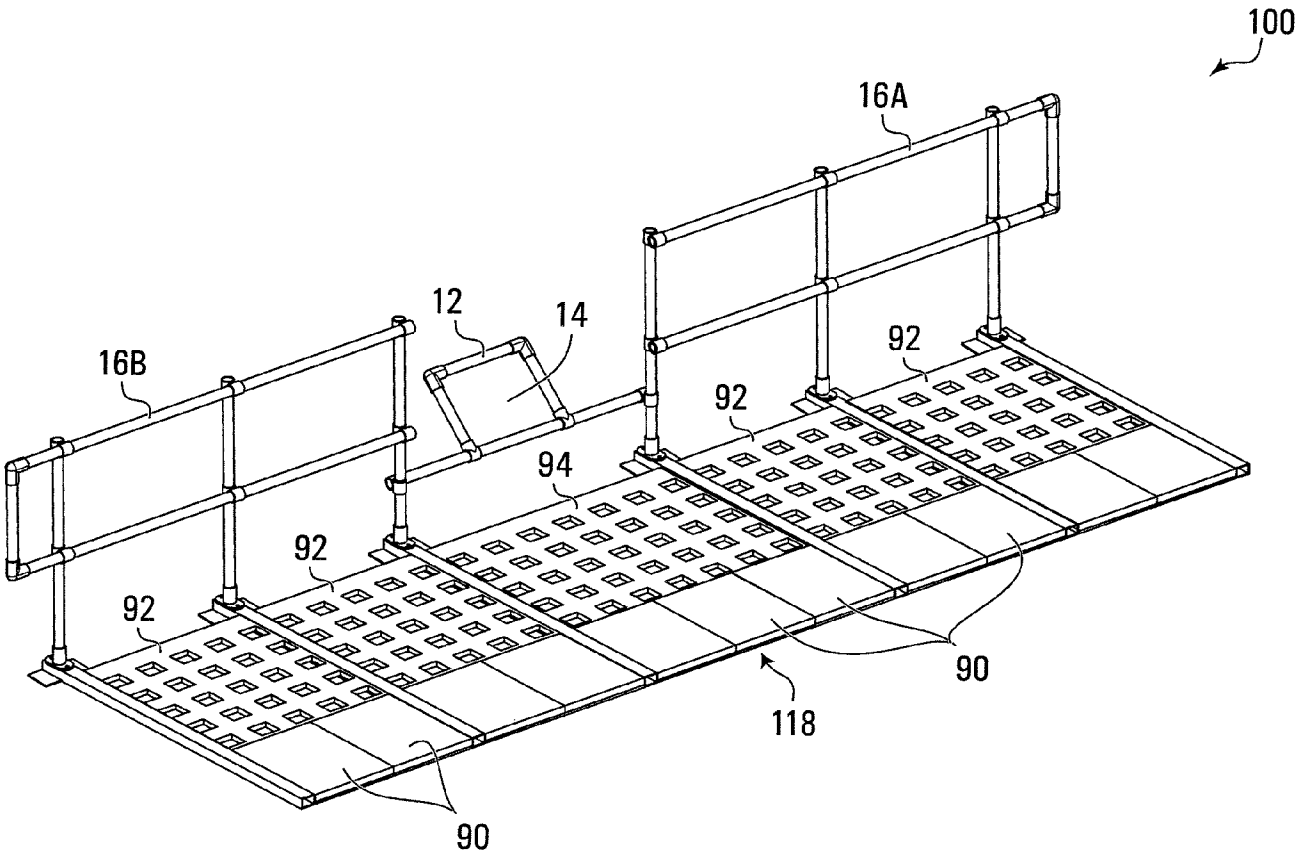
FIG. 10 is a is a rear perspective view of a roof safety assembly, exemplary of another embodiment.

FIG. 10 depicts roof safety assembly 100, according to another embodiment, with base 18 replaced with base 118. As depicted, in this embodiment, the top surface of base 118 is partly covered with four panels 92 and a panel 94. Unlike panels 70 and 72 of base 18, panels 92 and 94 of base 118 do not extend from barriers 16A/16B all the way to the back edge of the base. Rather, panels 92 and 94 terminate near the back of base 118 where panels 92 and 94 meet a row of weighted elements 90. Panels 92 and 94 may be alike to panels 70 and 72 in other aspects, e.g., panels 92 and 94 may be formed from the same materials as panels 70 and 72, as discussed above.

Like weighted elements 78 and 80 of roof safety assembly 10, weighted elements 90 are supported by support rails 74 and 76. Weighted elements 90 are also supported by additional support members (not shown) which extend perpendicularly to support rails 74 and 76 underneath weighted elements 90 and are attached to elongate support members 64A/B, 66A/B, and 68A/B.

Unlike weighted elements 78 and 80 of roof safety assembly 10, weighted elements 90 are not covered by panels. Rather, weighted elements 90 are coplanar with panels 92 and 94; weight elements 90 and panels 92/94 collectively form a substantially planar working surface, on which workers can walk. As such, weighted elements 90 have a substantially flat top surface and are adapted to support workers thereon. Further, weighted elements 90 are formed from material substantially heavier than panels 92 and 94. In the depicted embodiment, each weighted element 90 is a concrete paving slab. In other embodiments, these concrete paving slabs may be replaced with other suitable weighted elements.

Further, unlike weighted elements 78 and 80 of roof safety assembly 10, which are contained in the space within base 18 below panels 70 and 72, weighted elements 90 of roof safety assembly 100 extend to the top surface of base 118. As such, weighted elements 90 of roof safety assembly 100 can be larger, and therefore more massive than weighted elements 78 and 80 of roof safety assembly 10. In the depicted embodiment, each of the concrete paving slabs used as a weighted element 90 has a mass of approximately 20 kg. Accordingly, the combined mass of the eleven concrete paving slabs of roof safety assembly 100 is approximately 220 kg, which is approximately twice the total mass of the weighted elements of roof safety assembly 10.

As will be appreciated, weighted elements 90 of roof safety assembly 100 form a counterweight that functions in substantially the same manner as the counterweight discussed above for roof safety assembly 10. As before, the counterweight formed from weighted elements 90 is located at a distance behind barriers 16A/16B and ladder restraint 12, and thereby prevents tipping of barriers 16A/16B off of a roof and tipping of a ladder secured in ladder restraint 12 away from the roof. Further, as before, this counterweight extends laterally to the left and right of ladder restraint, and thereby prevents left and right sideways tipping of a ladder secured in ladder restraint 12.

Figure 11:
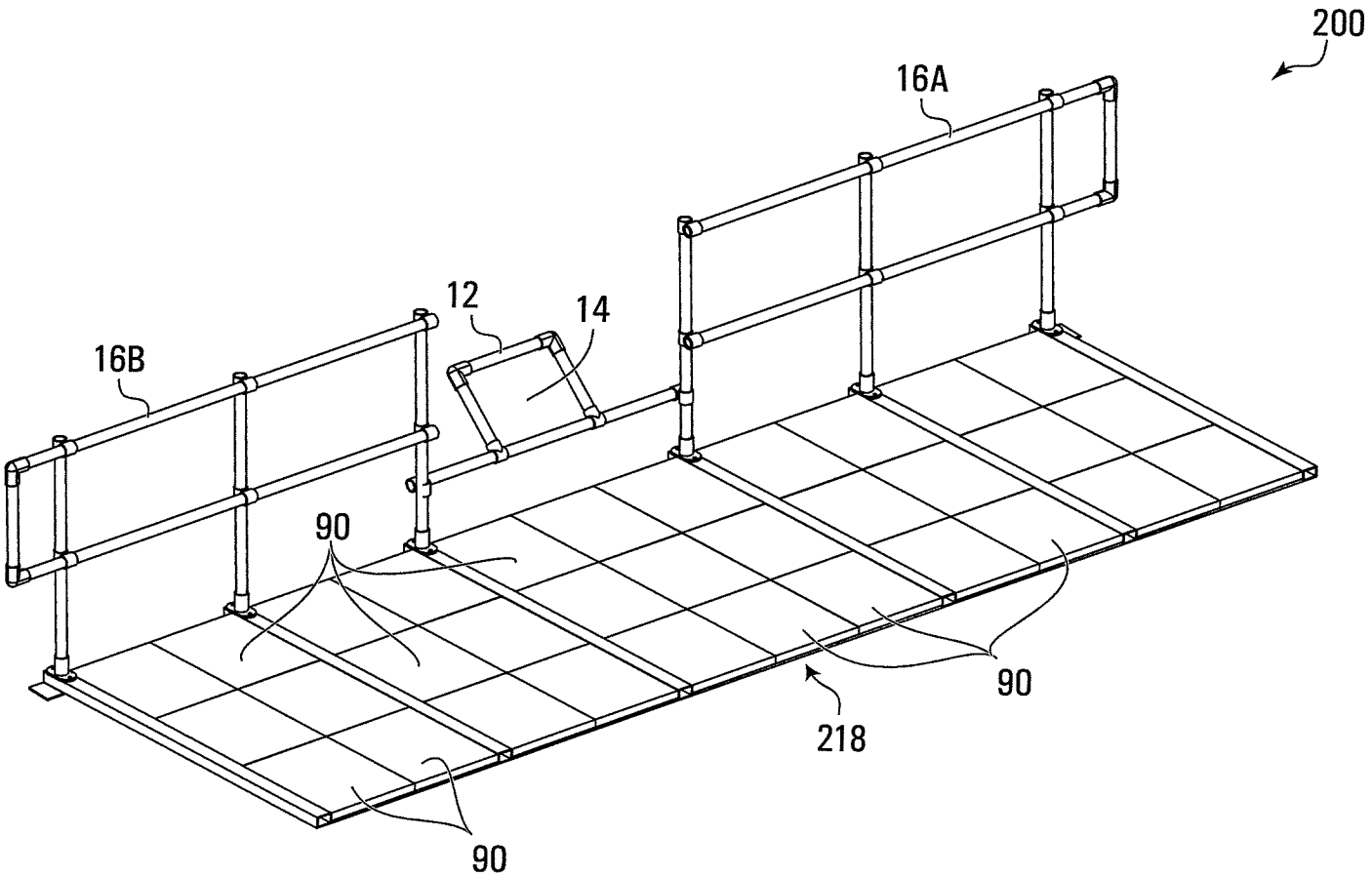
FIG. 11 is a is a rear perspective view of a roof safety assembly, exemplary of yet another embodiment.

FIG. 11 depicts roof safety assembly 200, according to a further embodiment, with base 18/118 replaced with base 218. As depicted, in this embodiment, the top surface of base 218 is substantially covered with weighted elements 90, arranged to form a substantially planar working surface, on which workers can walk. As such, the panels of safety assemblies 10 and 100 may be omitted.

As in roof safety assembly 100, weighted elements 90 of roof safety assembly 200 are supported by support rails 74 and 76. They are also supported by additional support members (not shown) which extend perpendicularly to support rails 74 and 76 underneath weighted elements 90 and are attached to elongate support members 64A/B, 66A/B, and 68A/B.

In the depicted embodiment, each weighted elements 90 of roof safety assembly 200 is a concrete paving slab, having a mass of approximately 20 kg. The combined mass of weighted elements 90 of roof safety assembly 200 is therefore approximately 660 kg. As such, roof safety assembly 200 may be used in situations calling for additional counterweight.

In yet other embodiments, elongate support members 64A/B, 66A/B, and 68A/B may, by themselves, have sufficient mass to form the counterweight described above. To this end, elongate support members 64A/B, 66A/B, and 68A/B may be made formed from or include any of the materials described above for forming weighted elements. In such embodiments, no additional weighted elements are required.

Figure 12:
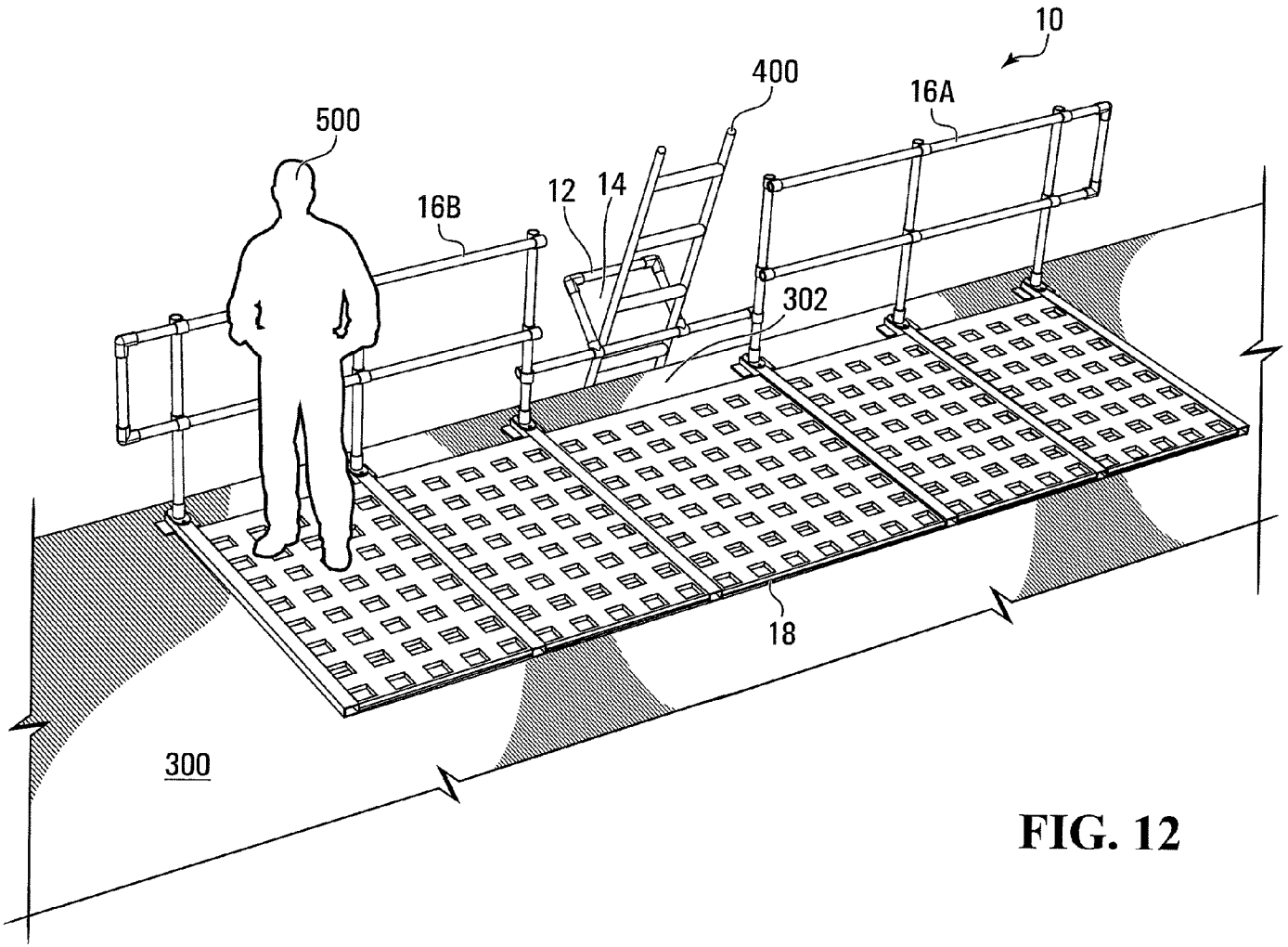
FIG. 12 is a rear perspective view of the roof safety assembly of FIG. 1 during operation.
Figure 13:
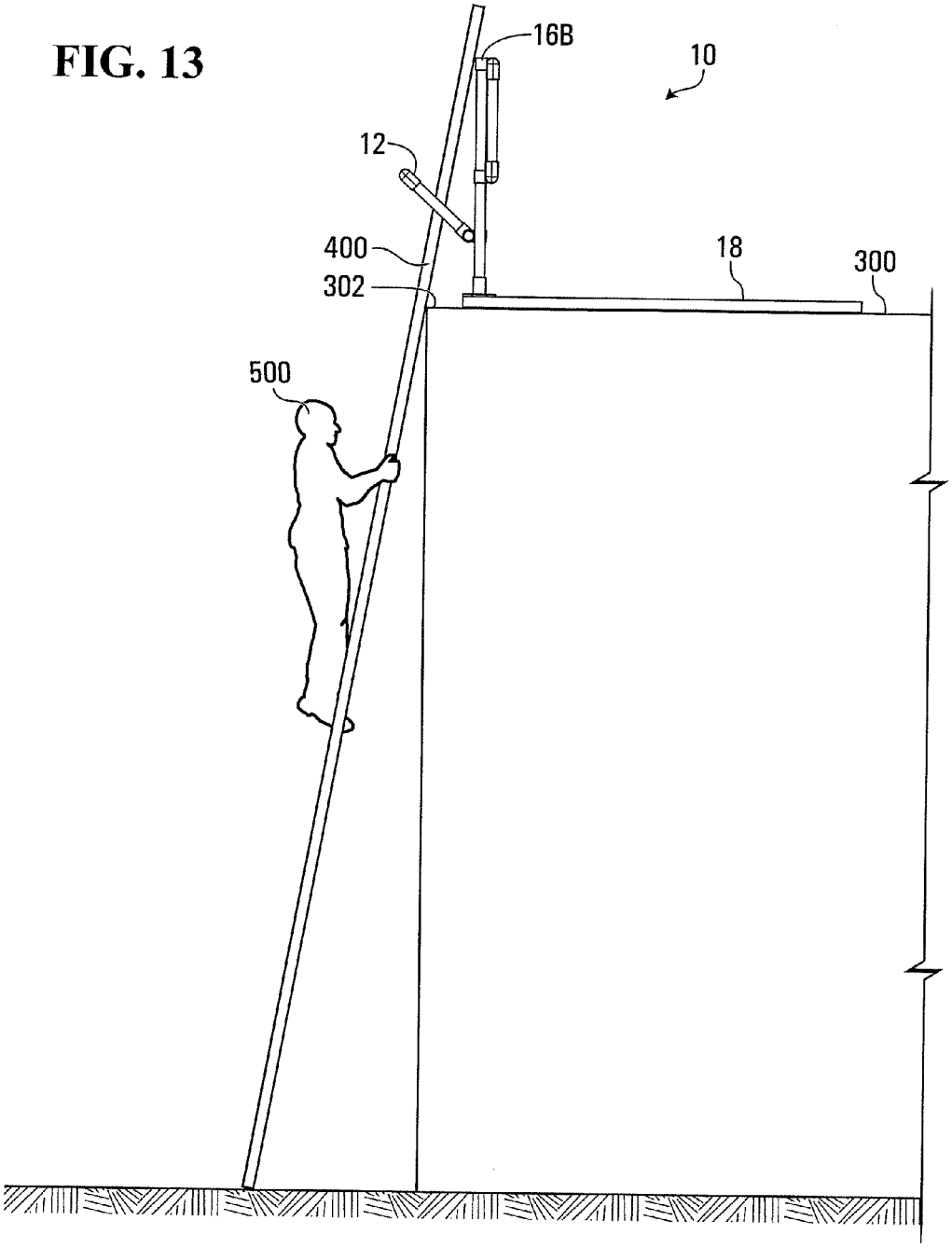
FIG. 13 is a right elevation view of the roof safety assembly of FIG. 1 during operation.

FIGS. 12 and 13 depict roof safety assembly 10 in operation. As depicted, roof safety assembly 10 is assembled on roof 300 of a building near an edge 302 to protect falls by a worker working on or accessing roof 300. In particular, base 18 is placed on roof 300, and ladder restraint 12 and barriers 16A/B are attached to base 18. As depicted, barriers 16A/B extend substantially parallel to edge 302 on left and right sides of ladder restraint 12. As worker 500 moves on top of base 18, the counterweight of base 18 prevents worker 500 from tipping barriers 16A/B off roof 300. Thus, roof safety assembly 100 protects worker 500 from falling off of roof 300.

Further, as depicted, a portable ladder 400 is used to access roof 300. Ladder 400 is received through opening 14 of ladder restraint 12. Meanwhile, ladder 400 is erected to rest against the building at edge 302, at an angle of approximately 75° from vertical in accordance with conventional safety practices. With ladder 400 received through opening 14, the counterweight of base 18 prevents ladder 400 from tipping while worker 500 is using it. In this way, roof safety assembly 100 protects worker 500 from falling when using ladder 400 to access roof 300.

Conveniently, ladder restraint 12 may be adapted in the field to suit particular roof and roof parapet configurations. For example, the position of ladder restraint 12 may be adjusted up or down by changing the height at which horizontal bar 32 is attached to posts 34A and 34B. Further, the angle at which ladder restraint 12 is offset from upstanding barriers 16A/B may be adjusted by changing the angle at which tee fittings 44 are secured to horizontal mounting bar 32. The position and the angle of ladder restraint 12 may be adjusted to allow ladder restraint 12 to receive a ladder, while accommodating roofs of different heights, as well as roof parapets of different heights and widths. Furthermore, the height of horizontal bar 32 may be adjusted in the field such that a ladder may be rested against it. Similarly, ladder restraint 12 could be modified in the field to include a bar 37 (FIGS. 6C/6D) mounted to posts 34A and 34B at a height to allow a ladder to be rested against bar 37. In these ways, a ladder received in ladder restraint 12 may be offset from a roof edge, a parapet edge, roof fixtures, and/or a roof features, as desired.

Conveniently, embodiments of the roof safety assembly described herein allow portable ladders such as, e.g., a conventional extension ladder, to be used to access a roof, even when safety regulations require the tops ends of ladders to be secured prior to use. Accordingly, certain drawbacks associated with installation of permanent ladders may be avoided, such as, for example, vulnerability of permanent ladders to vandalism or weather damage, and the risk of unauthorized access to roofs. Further, use of portable ladders leaned at an angle, as provided herein, also avoids the need to comply with government safety regulations that specifically govern the use of vertical ladders.

Conveniently, the modular design of embodiments of the roof safety assembly facilitates ready transport of components to and from building roofs, and assembly and disassembly in situ. As such, embodiments of the roof safety assembly may be distributed in the form of kits, with components of the roof safety assembly unassembled or partially assembled. Such kits may be assembled on a roof of a building to provide a roof safety assembly for use in manners described herein.

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A self-supporting safety assembly for free-standing placement on a roof of a building, near an edge of said roof, said safety assembly comprising:

a base having a surface for placement on said roof, an upstanding barrier that extends generally vertically from said base comprising a left upstanding section extending from a left vertical post, a right upstanding section extending from a right upstanding post, and a vertical opening therebetween, and a horizontal bar extending between said right upstanding post and said left upstanding post, at a height above said base in said vertical opening;

a counter-weighted ladder restraint extending from said horizontal bar at an angle offset from vertical in a direction away from said base, said ladder restraint having an opening adapted to receive a ladder resting on said horizontal bar, that provides access to said roof wherein said opening is sized so as to restrict left and right sideways movement and rearward movement of the ladder received therethrough; and said base comprising a weight interconnected with said ladder restraint and said upstanding barrier to allow said self-supporting safety assembly to be placed on said roof without being affixed thereto, said weight disposed at a distance from said ladder restraint and said upstanding barrier and having a mass so as to oppose tipping of said upstanding barrier by said user and tipping of said ladder away from said roof when received through said ladder restraint, and having portions located on left and right sides of said ladder restraint so as to oppose left and right sideways movement of said ladder restraint.

2. The safety assembly of claim 1, wherein said weight is spaced from said upstanding barrier, behind said upstanding barrier, to prevent said tipping of said upstanding barrier by said user.

3. The safety assembly of claim 1, wherein said weight comprises a plurality of weighted elements.

4. The safety assembly of claim 3, wherein said plurality of weighted elements comprises elements formed from metal, concrete, stone, ceramic, sand, rubber or plastic.

5. The safety assembly of claim 3, wherein said plurality of weighted elements are arranged to form a substantially planar walking surface.

6. The safety assembly of claim 3, further comprising a plurality of panels formed from material lighter than said plurality of weighted elements.

7. The safety assembly of claim 6, wherein said plurality of panels cover said plurality of weighted elements and form a substantially planar walking surface.

8. The safety assembly of claim 6, wherein said plurality of panels and said plurality of weighted elements are arranged to form a substantially planar walking surface.

9. The safety assembly of claim 1, wherein said upstanding barrier comprises a guard rail.

10. The safety assembly of claim 9, wherein said guard rail is formed from metal or plastic tubing.

11. The safety assembly of claim 1, wherein said ladder restraint is mounted to said upstanding barrier.

12. The safety assembly of claim 1, wherein said angle is approximately 45°.

13. The safety assembly of claim 1, further comprising a support that allows said ladder to be rested thereon without contacting said roof, when said ladder is received through said ladder restraint.

14. The self-supporting safety assembly of claim 1, wherein said height of said horizontal bar may be adjusted vertically.

15. A self-supporting safety assembly for free standing placement on a roof of a building, near an edge of said roof, said safety assembly comprising:

a base having a surface for placement on said roof;

an upstanding barrier that extends generally vertically from said base, said upstanding barrier comprising a left upstanding section extending from a left vertical post, a right upstanding section extending from a right upstanding post, and a vertical opening therebetween, and further comprising a horizontal bar extending between said right upstanding post and said left upstanding post, at a height above said base in said vertical opening;

a counter-weighted ladder restraint extending from said horizontal bar at an angle offset from vertical, in a direction away from said base, said ladder restraint having an opening adapted to receive a ladder extending therethrough when resting on said horizontal bar to provide access to said roof wherein said opening is sized so as to restrict left and right sideways and rearward movement of the ladder received therethrough;

wherein gaps between said ladder restraint and said left post and said right post allow a user to climb from said ladder onto said roof when said safety assembly is placed on said roof;

said base comprising a weight interconnected with said ladder restraint and said upstanding barrier to allow said self-supporting safety assembly to be placed on said roof without being affixed thereto, said weight disposed at a distance from said ladder restraint and said upstanding barrier and having a mass so as to oppose tipping of said upstanding barrier by said user and tipping of said ladder away from said roof when received in said ladder restraint, and having portions located on left and right sides of said ladder restraint so as to oppose left and right sideways movement of said ladder restraint.

16. The free standing safety assembly of claim 15, wherein said ladder restrain extends from said base at an angle of approximately 45° relative to vertical.

17. The self-supporting safety assembly of claim 15, wherein said height of said horizontal bar may be adjusted vertically.

* * * * *